US008405480B2

(12) United States Patent
Fiseni et al.

(10) Patent No.: US 8,405,480 B2
(45) Date of Patent: Mar. 26, 2013

(54) ELECTRICAL ASSEMBLY FOR USE WITH A ROTARY TRANSFORMER AND METHOD FOR MAKING THE SAME

(75) Inventors: Alexander Felix Fiseni, Munich (DE); Jan Hemmelmann, Munich (DE); Stefan Brandhoff, Munich (DE)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 12/963,822

(22) Filed: Dec. 9, 2010

(65) Prior Publication Data

US 2011/0121931 A1 May 26, 2011
US 2011/0285490 A2 Nov. 24, 2011

(51) Int. Cl.
*H01F 21/06* (2006.01)
*H01F 21/04* (2006.01)
*H01F 7/06* (2006.01)

(52) U.S. Cl. ..... 336/130; 336/115; 336/118; 336/119; 336/120; 336/131; 336/132; 336/135; 29/602.1

(58) Field of Classification Search ..... 336/142, 336/145, 212, 216, 115–136; 29/602.1
See application file for complete search history.

(56) References Cited

U.S. PATENT DOCUMENTS

| | | | | |
|---|---|---|---|---|
| 2,330,824 | A * | 10/1943 | Granfield | 29/609 |
| 4,041,541 | A * | 8/1977 | Frossard et al. | 361/27 |
| 5,359,312 | A * | 10/1994 | Choi | 336/84 M |
| 5,442,956 | A * | 8/1995 | Persson | 73/117.02 |
| 5,572,178 | A * | 11/1996 | Becker et al. | 336/120 |
| 6,483,218 | B1 * | 11/2002 | Petrinko | 310/112 |
| 6,713,982 | B2 | 3/2004 | Burse | |
| 7,605,681 | B2 | 10/2009 | Wobben | |
| 7,687,965 | B2 * | 3/2010 | Ionel et al. | 310/216.037 |
| 7,847,671 | B1 * | 12/2010 | Riachentsev et al. | 336/220 |
| 2002/0057164 | A1 * | 5/2002 | Jin et al. | 336/115 |
| 2007/0040642 | A1 | 2/2007 | Mast et al. | |
| 2007/0188284 | A1 | 8/2007 | Dobbs | |

FOREIGN PATENT DOCUMENTS

WO 2010081654 A1 7/2010

* cited by examiner

*Primary Examiner* — Mohamad Musleh
*Assistant Examiner* — Mangtin Lian
(74) *Attorney, Agent, or Firm* — Ann M. Agosti

(57) ABSTRACT

An electrical assembly is provided. The electrical assembly includes a ring having at least two annular segments. Each annular segment includes a first portion and a second portion. The second portion tapers from the first portion toward an end of the second portion to define a circumferential cross-sectional area of the ring that is substantially constant along a radius of the electrical assembly. At least one winding is coupled about the ring.

17 Claims, 7 Drawing Sheets

ELECTRICAL ASSEMBLY FOR USE WITH A ROTARY TRANSFORMER AND METHOD FOR MAKING THE SAME

BACKGROUND OF THE INVENTION

The embodiments described herein relate generally to a rotary transformer and, more particularly, to an electrical assembly for use with a rotary transformer.

At least some known rotary transformers include electrical assemblies, such as a rotor and a stator, having at least one ring of active material and at least one winding coupled about the ring. As used herein, the term "electrical assembly" refers to a rotor and/or a stator, and the term "active material" refers to a material having properties that enable a magnetic field to be shaped, i.e., control a direction and/or a magnitude of flux lines in a magnetic field. At least one known rotary transformer includes electrical assembly rings each formed from a plurality of segments. The known segmented electrical assemblies are configured for use in high-power and/or high-frequency applications, such as exciting a generator using 20 kilo-Hertz (kHz) power.

For example, such a known rotary transformer includes ferrite, which has a magnetic flux density of about 500 milli-Tesla (mT), as the active material. Known ferrites that are used in rotary transformers and/or electromagnetic cores contain nickel, zinc, and/or manganese compounds. Such ferrites have a low coercivity and are referred to as soft ferrites. The low coercivity enables the soft ferrites' magnetization to reverse direction without dissipating much energy, i.e. hysteresis losses. Further, soft ferrites' high resistivity prevents eddy currents in the transformers and/or the cores, which also causes energy loss. Because of their comparatively low losses at high frequencies, soft ferrites are extensively used in cores of radio frequency transformers.

Moreover, each segment of active material of the known electrical assembly has a substantially rectangular axial cross-sectional shape, such that a circumferential cross-sectional area of the segment increases as a radius increases. As such, a cross-section of active material of the electrical assembly varies with the radius. Further, along the axial cross-section, each segment of the ring is substantially U-shaped and formed from one or three pieces.

At least some known electrical assemblies include a cable extending from windings of the electrical assembly, outward through the active material of the electrical assembly. In at least some known electrical assemblies, a hole is drilled through the active material to enable the cable to extend through the active material. However, drilling may cause stress in and/or damage the active material. For example, at least some known electrical assemblies include a brittle material as the active material and, as such, drilling may damage or stress the brittle material.

BRIEF DESCRIPTION OF THE INVENTION

In one aspect, an electrical assembly is provided. The electrical assembly includes a ring having at least two annular segments. Each annular segment includes a first portion and a second portion. The second portion tapers from the first portion toward an end of the second portion to define a circumferential cross-sectional area of the ring that is substantially constant along a radius of the electrical assembly. At least one winding is coupled about the ring.

In another aspect, a rotary transformer is provided. The rotary transformer includes a stator and a rotor positioned proximate to the stator. At least one of the stator and the rotor includes a ring having at least two annular segments. Each annular segment includes a first portion and a second portion. The second portion tapers from the first portion toward an end of the second portion to define a circumferential cross-sectional area of the ring that is substantially constant along a radius of the electrical assembly. At least one winding is coupled about the ring.

In yet another aspect, a method of making an electrical assembly having a longitudinal axis and a radius substantially perpendicular to the longitudinal axis is provided. The method includes coupling at least two annular segments circumferentially about the longitudinal axis of the electrical assembly to form a ring. The at least two annular segments each include a first portion and a second portion. The second portion tapers from the first portion toward an end of the second portion to define a circumferential cross-sectional area of the ring that is substantially constant along a radius of the electrical assembly. At least one winding is coupled about the at least two annular segments.

BRIEF DESCRIPTION OF THE DRAWINGS

FIG. 1 is an axial cross-sectional view of an exemplary rotary transformer.

FIG. 2 is an axial cross-sectional view of exemplary rings that may be used with the rotary transformer shown in FIG. 1.

FIG. 3 is a perspective axial view of a segment of a primary ring that may be used with the rotary transformer shown in FIGS. 1 and 2.

FIG. 4 is a perspective radial view of an exemplary primary sub-ring formed from a plurality of segments, as shown in FIG. 3.

FIG. 5 is a perspective axial view of a segment of a secondary ring that may be used with the rotary transformer shown in FIGS. 1 and 2.

FIG. 6 is a perspective radial view of an exemplary secondary sub-ring formed from a plurality of segments, as shown in FIG. 5.

FIG. 7 is an axial cross-sectional view of a portion of the rings shown in FIG. 2.

FIG. 8 is a circumferential cross-sectional view of the portion shown in FIG. 7 at a first radius value.

FIG. 9 is a circumferential cross-sectional view of the portion shown in FIG. 7 at a second radius value.

FIG. 10 is an axial cross-sectional view of the rings shown in FIG. 2 with flux lines and magnetic density illustrated.

DETAILED DESCRIPTION OF THE INVENTION

The embodiments described herein provide segmented electrical assemblies for use with a rotary transformer. Segments of each electrical assembly are configured to have a circumferential cross-sectional area that is substantially constant along a radius of the electrical assembly. The rotary transformer described herein is configured to operate at a power less than, or equal to, about 25 kilo-Watts (kW) and at a frequency of about 50 Hertz (Hz) and/or of about 60 Hz. As such, the herein-described rotary transformer can be used to transmit power from a stationary nacelle of a wind turbine to a rotating hub of the wind turbine to provide energy to blade pitching drives.

Figure 1:
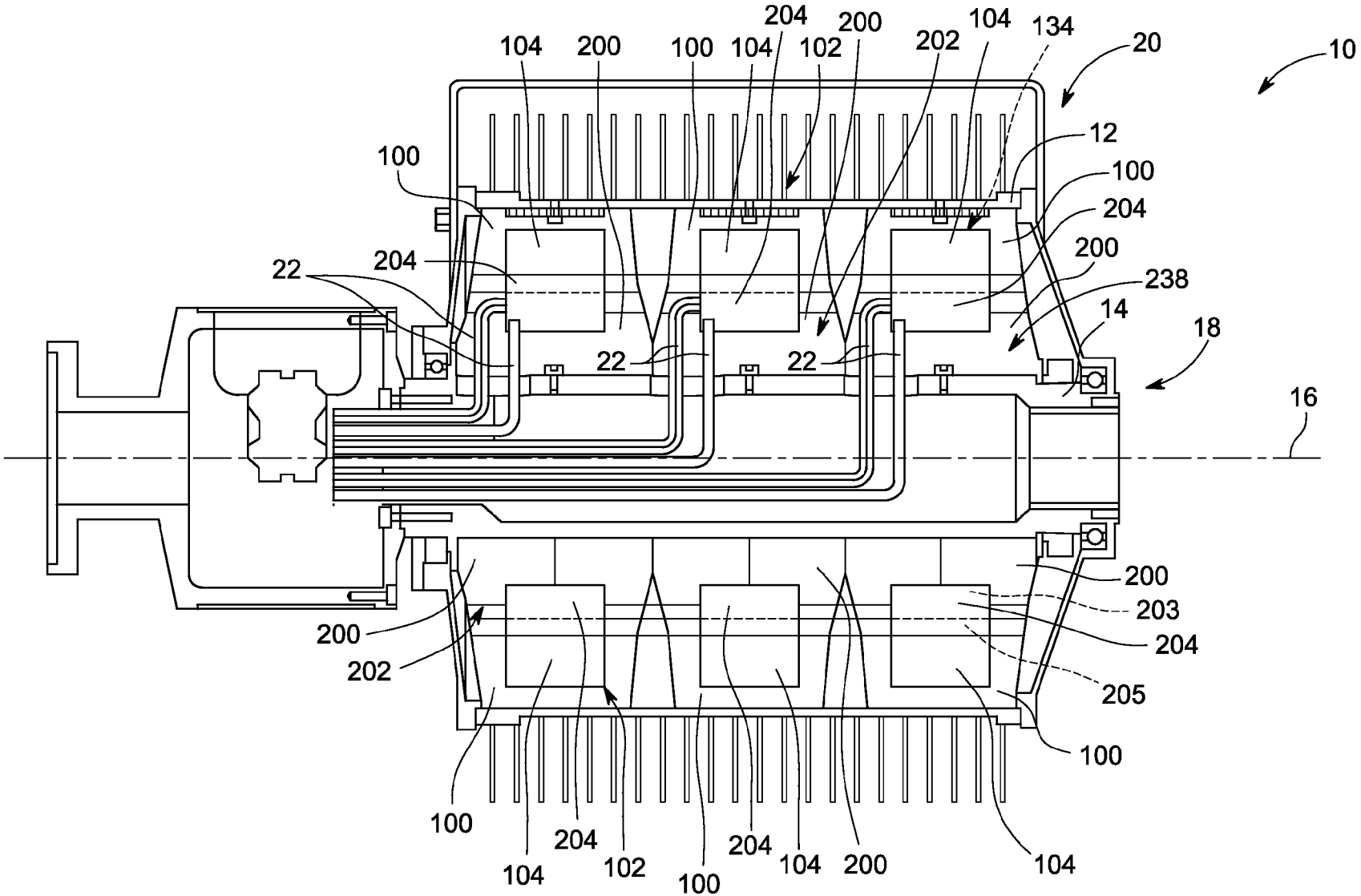
FIGS. 1-10 show exemplary embodiments of the assemblies and methods described herein.

FIG. 1 is an axial cross-sectional view of an exemplary rotary transformer 10. In the exemplary embodiment, rotary transformer 10 includes a housing 12 and a core 14 positioned within housing 12. Core 14 is substantially cylindrical and has a longitudinal axis 16. Longitudinal axis 16 of core 14 is also the longitudinal axis of rotary transformer 10 and electrical assemblies 100 and 200 and, as such, only one longitudinal axis 16 is referred to herein. In alternative embodiments, the longitudinal axis of rotary transformer 10 and/or electrical assembly 100 and/or 200 does not coincide with longitudinal axis 16 of core 14.

As referred to herein, a radial direction is defined substantially perpendicularly to longitudinal axis 16, and a circumferential direction is defined generally perpendicular to the radial direction and longitudinal axis 16. A longitudinal direction is substantially parallel to longitudinal axis 16. Further, as used herein, an axial cross-section is a cross-section taken substantially parallel to longitudinal axis 16, a radial cross-section is a cross-section taken substantially perpendicular to longitudinal axis 16, and a circumferential cross-section is a cross-section taken at a circumference of a circle having longitudinal axis 16 as its center.

In the exemplary embodiment, at least one electrical assembly, such as a primary electrical assembly 100, is coupled to housing 12, and at least one electrical assembly, such as a secondary electrical assembly 200, is coupled to core 14. In the exemplary embodiment, rotary transformer 10 includes three primary electrical assemblies 100 coupled to housing 12 and three secondary electrical assemblies 200 coupled to core 14 such that rotary transformer 10 has a multi-phase design. Core 14 and housing 12 are configured to rotate with respect to each other. For example, in the exemplary embodiment, core 14 rotates with respect to stationary housing 12 such that core 14 and secondary electrical assembly 200 form a rotor 18 and housing 12 and primary electrical assembly 100 form a stator 20. Alternatively, housing 12 rotates with respect to stationary core 14 such that core 14 and secondary electrical assembly 200 form a stator and housing 12 and primary electrical assembly 100 form a rotor.

Primary electrical assembly 100 includes, in the exemplary embodiment, a primary ring 102 and at least one primary winding 104, and secondary electrical assembly 200 includes a secondary ring 202 and at least one secondary winding 204. In a particular embodiment, primary electrical assembly 100 includes a plurality of primary windings 104 and/or secondary electrical assembly 200 includes a plurality of secondary windings 204 to enable rotary transformer 10 to operate at different voltage levels. When electrical assembly 100 and/or 200 includes a plurality of windings 104 and/or 204, respectively, each winding 104 or 204 of the plurality of windings 104 or 204 is configured to operate at a voltage level different than another winding 104 or 204 of the plurality of windings 104 or 204. In one embodiment, secondary electrical assembly 200 includes a first secondary winding 203 configured to operate at a first voltage level and a second secondary winding 205 configured to operate at a second voltage level that is different than the first voltage level. In the exemplary embodiment, leads 22 extend from secondary windings 204 through secondary ring 202, into core 14 and connect to another component (not shown). Alternatively, or additionally, leads extend from primary windings 104 through primary ring 102 and connect to another component (not shown).

Primary ring 102 and secondary ring 202 each include a powdered iron as the active material, in the exemplary embodiment. For example, primary ring 102 and secondary ring 202 are each formed from SOMALOY® ("Somaloy" is a registered trademark of Höganäs AB Corp. of Höganäs, Sweden) soft magnetic composite. In a particular embodiment, primary ring 102 and/or secondary ring 202 are formed from an active material having a magnetic flux density of about 1600 mT. In alternative embodiments, primary ring 102 and/or secondary ring 202 is formed from any suitable active material that enables rotary transformer 10 to function as described herein. Further, although primary ring 102 and secondary ring 202 are described herein as being substantially cylindrical and having a substantially circular radial cross-sectional shape, primary ring 102 and/or secondary ring 202 may be generally cylindrical or tubular with a polygonal radial cross-sectional shape, a shown in FIG. 11.

Figure 2:
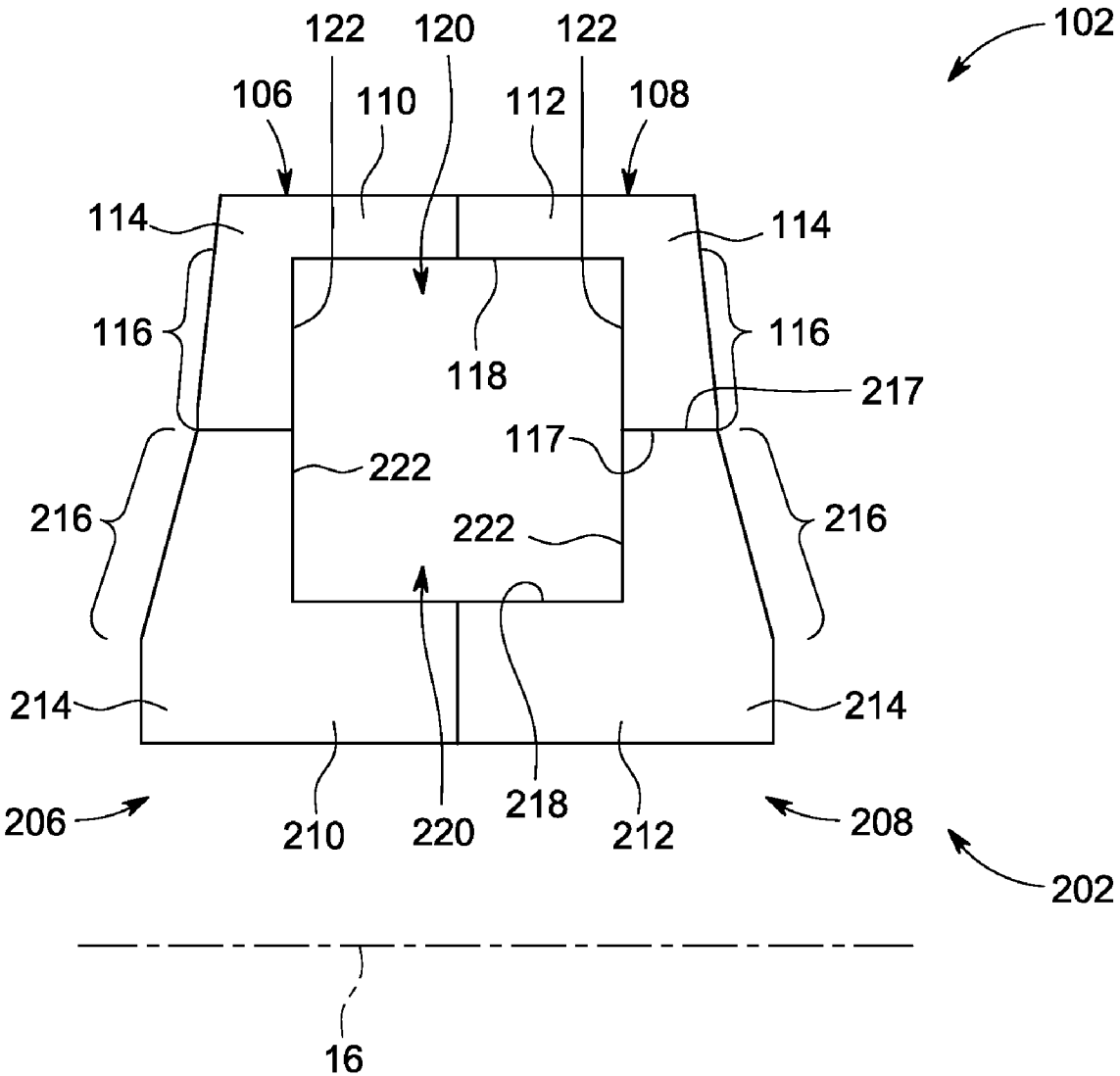
Figure 4:
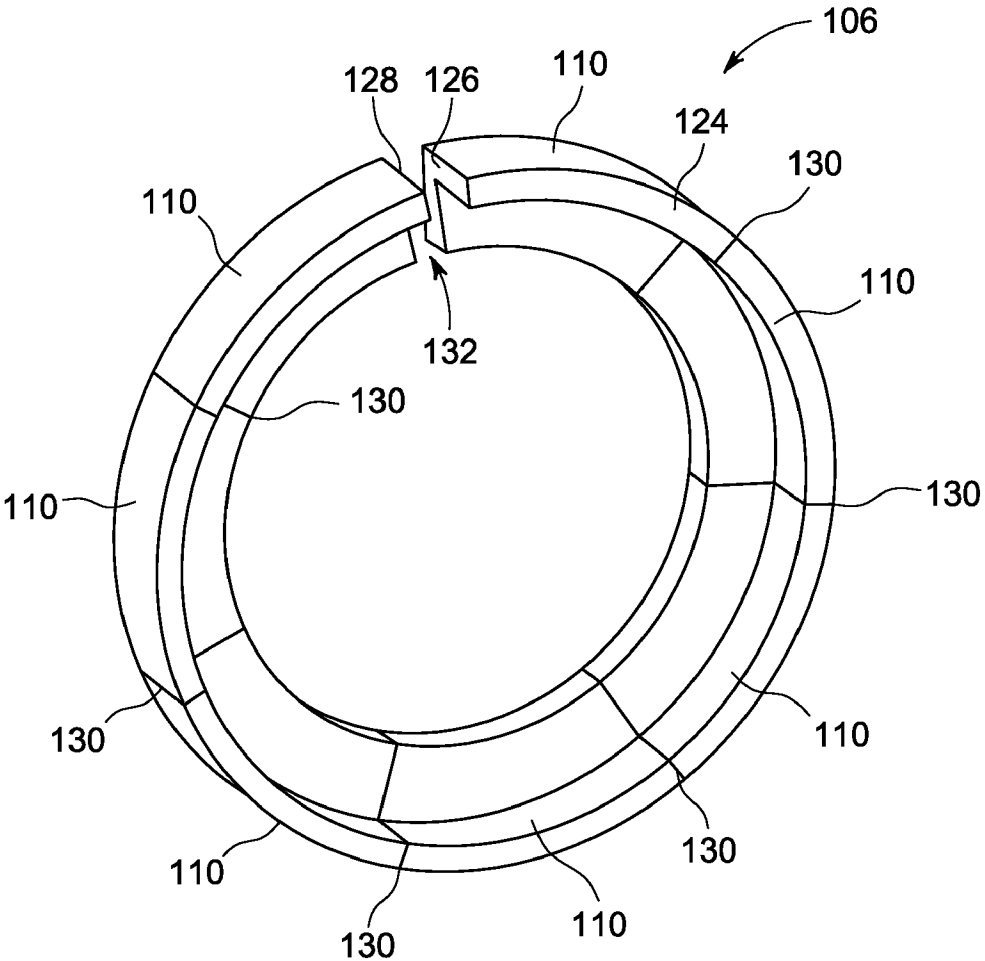
Figure 3:
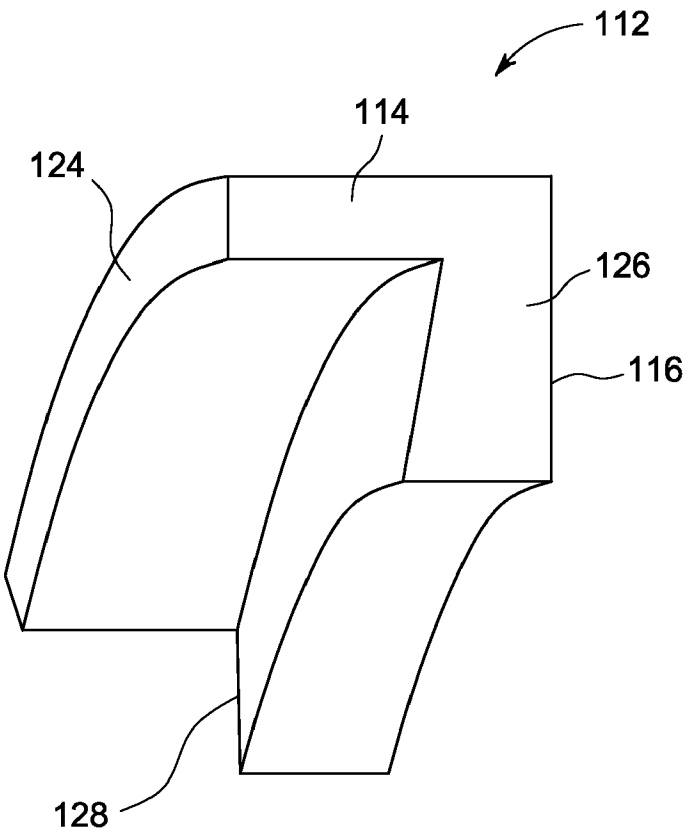
Figure 6:
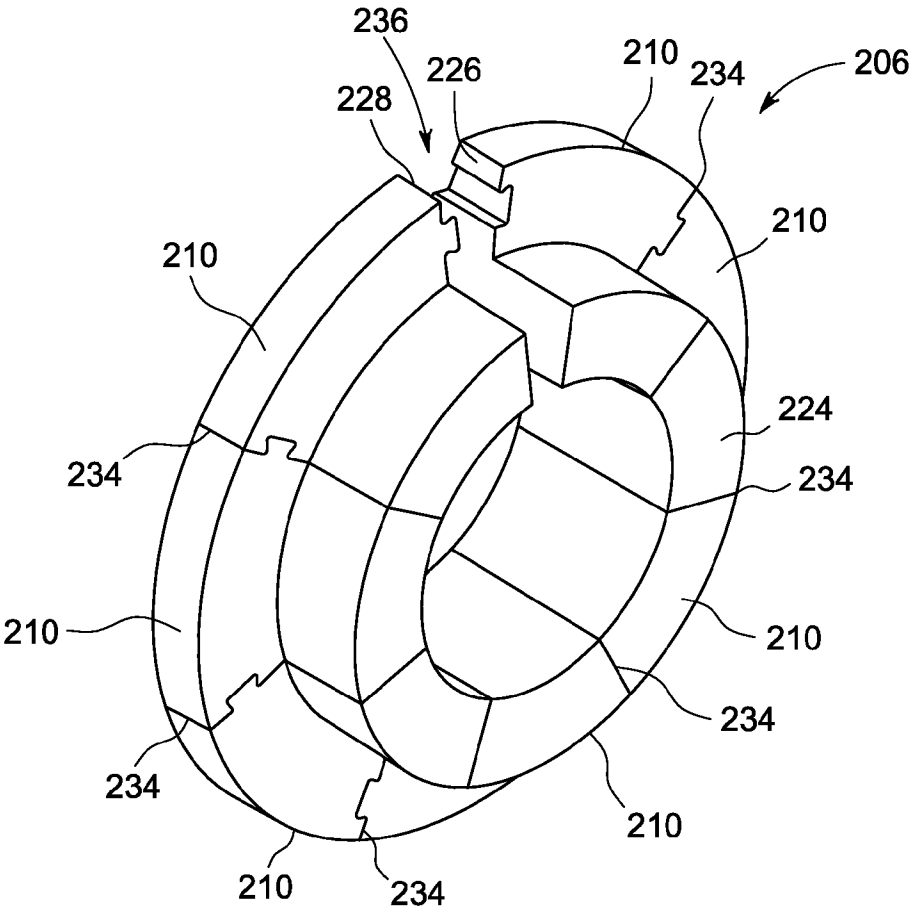
Figure 5:
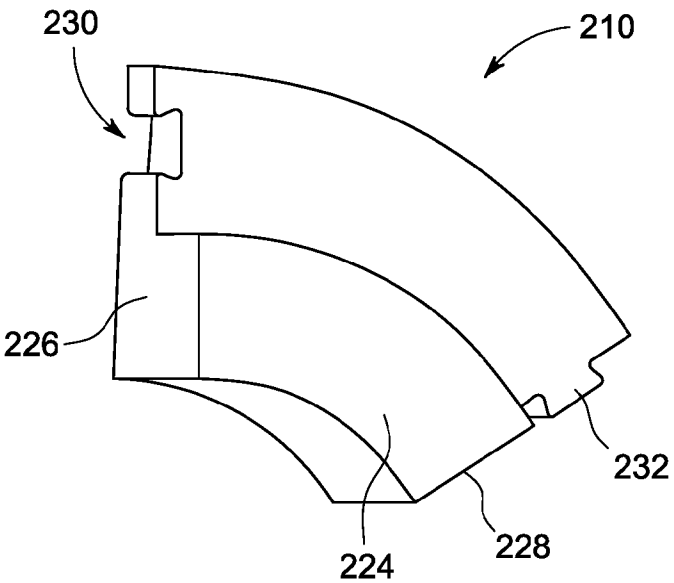

FIG. 2 is an axial cross-sectional view of exemplary rings 102 and 202, without windings 104 and 204, that may be used with rotary transformer 10 (shown in FIG. 1). FIG. 3 is a perspective axial view of a segment 112 of primary electrical assembly 100. FIG. 4 is a perspective radial view of an exemplary primary sub-ring 106 formed from a plurality of segments 110. FIG. 5 is a perspective axial view of a segment 210 of secondary electrical assembly 200. FIG. 6 is a perspective radial view of an exemplary secondary sub-ring 206 formed from a plurality of segments 210.

Referring to FIGS. 2-4, in the exemplary embodiment, primary ring 102 includes a first primary sub-ring 106 and a second primary sub-ring 108. Each primary sub-ring 106 and 108 is configured substantially similarly, except second primary sub-ring 108 is substantially a mirror-image of first primary sub-ring 106. Further, first primary sub-ring 106 includes a plurality of first primary sub-ring segments 110, and second primary sub-ring 108 includes a plurality of second primary sub-ring segments 112 that are substantially a mirror-image of first primary sub-ring segments 110. In a particular embodiment, first primary sub-ring 106 includes at least one first primary sub-ring segment 110, and second primary sub-ring 108 includes at least one second primary sub-ring segment 112. As such, primary ring 102 includes at least two annular segments 110 and/or 112.

Each segment 110 and 112 in the exemplary embodiment is generally L-shaped having a base 114 and a leg 116 that tapers from base 114 to a bottom end 117 of leg 116. Base 114 is also referred to herein as a first portion of segment 110 and/or 112, and leg 116 is also referred to herein a second portion of segment 110 and/or 112. When segments 110 and 112 are assembled to form primary ring 102, bases 114 define a bottom wall 118 of a recess 120, and legs 116 define side walls 122 of recess 120. More specifically, an axial end 124 of bases 114 of axially adjacent segments 110 or 112 abut and/or interlock, and legs 116 of segments 110 and 112 axially oppose each other along bases 114. As such, when segments 110 and 112 are positioned axially adjacent each other, segments 110 and 112 have a generally U-shaped axial cross-sectional shape defining recess 120. Recess 120 is configured to receive winding 104 therein. In an alternative embodiment, segments 110 and 112 are formed unitarily as one U-shaped segment with a base and two tapered legs defining a recess. When ring 102 includes at least two unitary U-shaped segments, the at least two unitary U-shaped segments are positioned circumferentially about housing 12 (shown in FIG. 1). In the exemplary embodiment, bases 114 are positioned adjacent housing 12 and legs 116 extend radially inward toward core 14 (shown in FIG. 1).

First primary sub-ring segments 110 are coupled in series circumferentially about longitudinal axis 16 to form first primary sub-ring 106, and second primary sub-ring segments 112 are coupled in series circumferentially about longitudinal axis 16 to form second primary sub-ring 108. Further, first primary sub-ring 106 and second primary sub-ring 108 are positioned in series along longitudinal axis 16 to form primary ring 102. As such, first primary sub-ring segments 110 and second primary sub-ring segments 112 are positioned in series along longitudinal axis 16. Each segment 110 and 112 includes a first circumferential end 126 and a second circumferential end 128. First circumferential end 126 of one segment 110 or 112 is configured to abut and/or interlock with second circumferential end 128 of a circumferentially adjacent segment 110 or 112. When sub-ring 106 and/or 108 is formed from segments 110 or segments 112, respectively, joints 130 are defined where a first circumferential end 126 abuts and/or interlocks with a second circumferential end 128. Joints 130 of first primary sub-ring 106 substantially co-linearly align with joints 130 of second primary sub-ring 108; however, it should be understood that joints 130 of first primary sub-ring 106 are not required to substantially co-linearly align with joints 130 of second primary sub-ring 108 and can be staggered or otherwise aligned.

In the exemplary embodiment, a gap 132 is defined in each sub-ring 106 and 108 between first circumferential end 126 of one segment 110 or 112, respectively, and a circumferentially adjacent second circumferential end 128 of segment 110 or 112. Joints 130 are defined at other abutting and/or interlocking ends 126 and 128 such that one gap 132 is defined in each sub-ring 106 and 108. Alternatively, sub-ring 106 and/or 108 includes other than one gap 132, such as no gaps 132 and/or a plurality of gaps 132. In the exemplary embodiment, gap 132 of first sub-ring 106 is substantially circumferentially aligned with gap 132 of second sub-ring 108 to define an access opening 134 (shown in FIG. 1) of primary ring 102. Access opening 134 is configured to enable a cable connected to primary winding 104 (shown in FIG. 1) to extend through primary ring 102 to another component (not shown). Alternatively, primary ring 102 does not include access opening 134.

Referring to FIGS. 2, 5, and 6, in the exemplary embodiment, secondary ring 202 includes a first secondary sub-ring 206 and a second secondary sub-ring 208. Each secondary sub-ring 206 and 208 is configured substantially similarly, except second secondary sub-ring 208 is substantially a mirror-image of first secondary sub-ring 206. Further, first secondary sub-ring 206 includes a plurality of first secondary sub-ring segments 210, and second secondary sub-ring 208 includes a plurality of second secondary sub-ring segments 212 that are substantially a mirror-image of first secondary rub-ring segments 210. In a particular embodiment, first secondary sub-ring 206 includes at least one first secondary sub-ring segment 210, and second secondary sub-ring 208 includes at least one second secondary sub-ring segment 212. As such, secondary ring 202 includes at least two annular segments 210 and/or 212.

Each segment 210 and 212 in the exemplary embodiment is generally L-shaped having a base 214 and a leg 216 that tapers from base 214 to a top end 217 of leg 216. Base 214 is also referred to herein as a first portion of segment 210 and/or 212, and leg 216 is also referred to herein a second portion of segment 210 and/or 212. When segments 210 and 212 are assembled to form secondary ring 202, base 214 defines a bottom wall 218 of a recess 220, and legs 216 define side walls 222 of recess 220. More specifically, an axial end 224 of bases 214 of axially adjacent segments 210 or 212 abut and/or interlock, and legs 216 of segments 210 and 212 axially oppose each other along bases 214. As such, when segments 210 and 212 are positioned axially adjacent to each other, segments 210 and 212 have a generally U-shaped axial cross-sectional shape defining recess 220. Recess 220 is configured to receive secondary winding 204 therein. In an alternative embodiment, segments 210 and 212 are formed unitarily as one U-shaped segment with a base and two tapered legs defining a recess. When ring 202 includes at least two unitary U-shaped segments, the at least two unitary U-shaped segments are positioned circumferentially about core 14 (shown in FIG. 1). In the exemplary embodiment, bases 214 are positioned adjacent core 14 and legs 216 extend radial outward toward housing 12 (shown in FIG. 1).

First secondary sub-ring segments 210 are coupled in series circumferentially about longitudinal axis 16 to form first secondary sub-ring 206, and second secondary sub-ring segments 212 are coupled in series circumferentially about longitudinal axis 16 to form second secondary sub-ring 208. Further, first secondary sub-ring 206 and second secondary sub-ring 208 are positioned in series along longitudinal axis 16 to form secondary ring 202. As such, first secondary sub-ring segments 210 and second secondary sub-ring segments 212 are positioned in series along longitudinal axis 16. Each segment 210 and 212 includes a first circumferential end 226 and a second circumferential end 228. First circumferential end 226 of one segment 210 or 212 is configured to abut and/or interlock with second circumferential end 228 of a circumferentially adjacent segment 210 or 212, respectively. More specifically, in the exemplary embodiment, first circumferential ends 226 include a groove 230, such as a dovetail groove, defined therein, and second circumferential ends 228 include a tab 232, such as a dovetail tab, projecting therefrom. Tabs 232 are configured to be inserted into a circumferentially adjacent groove 230 to couple segments 210 or 212 together. It should be understood that primary ring 102 can additionally or alternatively include grooves 230 and tabs 232.

When sub-ring 206 and/or 208 is formed from segments 210 or segments 212, respectively, joints 234 are defined where a first circumferential end 226 abuts and/or interlocks with a second circumferential end 228. Joints 234 of first secondary sub-ring 206 substantially co-linearly align with joints 234 of second secondary sub-ring 208; however, it should be understood that joints 234 of first secondary sub-ring 206 are not required to substantially co-linearly align with joints 234 of second secondary sub-ring 208 and can be staggered or otherwise aligned.

In the exemplary embodiment, a gap 236 is defined in each sub-ring 206 and 206 between first circumferential end 226 of one segment 210 or 212, respectively, and a circumferentially adjacent second circumferential end 228 of segment 210 or 212. Joints 234 are defined at other abutting and/or interlocking ends 226 and 228 such that one gap 236 is defined in each sub-ring 206 and 208. Alternatively, sub-ring 206 and/or 208 includes other than one gap 236, such as no gaps 236 and/or a plurality of gaps 236. In the exemplary embodiment, gap 236 of first sub-ring 206 is substantially circumferentially aligned with gap 236 of second sub-ring 208 to define an access opening 238 (shown in FIG. 1) of secondary ring 202. Access opening 238 is configured to enable a cable, such as leads 22, connected to secondary winding 204 to extend through secondary ring 202 and connect to another component (not shown). Alternatively, secondary ring 202 does not include access opening 238. Further, although groove 230 and tab 232 are shown at access opening 238 and/or gap 236, circumferential ends 226 and/or 228 may be flush where access opening 238 and/or gap 236 is defined.

Referring again to FIGS. 1 and 2, first sub-rings 106 and 206 are substantially radially aligned and second sub-rings 108 and 208 are substantially radially aligned such that primary winding 104 is positioned adjacent secondary winding 204. Further, in the exemplary embodiment, primary ring 102 is friction fit against housing 12 by primary windings 104, and secondary ring 202 is friction fit against core 14 by secondary windings 204. Alternatively, or additionally, primary ring 102 is coupled to housing 12 by fasteners, and/or secondary ring 202 is coupled to core 14 by fasteners.

Figure 7:
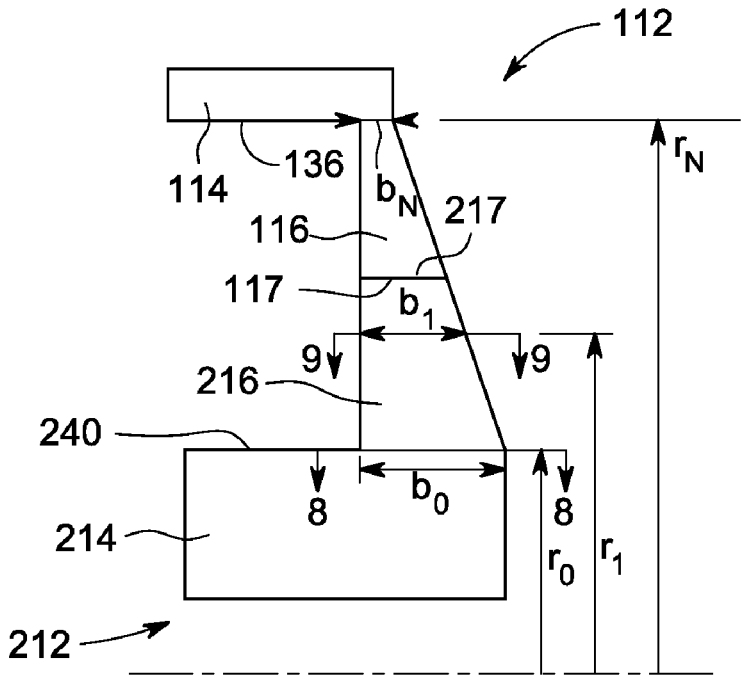
Figure 8:
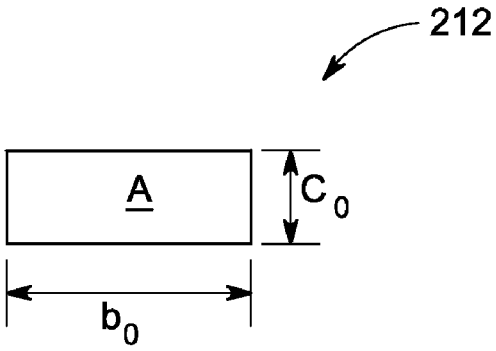
Figure 9:
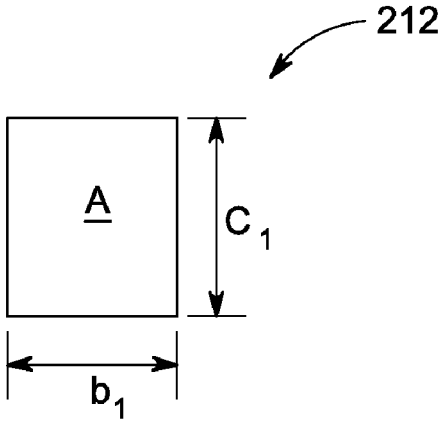

FIG. 7 is an axial cross-sectional view of a portion of rings 102 and 202 (shown in FIGS. 1-6). FIG. 8 is a circumferential cross-sectional view of rings 102 and 202 at a first radius value $r_0$ at line 8-8 shown in FIG. 7. FIG. 9 is a circumferential cross-sectional view of rings 102 and 202 at a second radius value $r_1$ at line 9-9 shown in FIG. 7.

Each ring segment 110, 112, 210, and 212 includes an axial cross-sectional shape (shown in FIG. 7) defining a circumferential cross-sectional area A (shown in FIGS. 8 and 9) that is substantially constant along a radius r of electrical assemblies 100 and 200 (shown in FIG. 1). For the sake of clarity, second secondary sub-ring segment 212 is referred to with respect to FIGS. 7-9, however, it should be understood that the following description applies to each ring segment 110, 112, 210, and 212.

In the exemplary embodiment, segment 212 has a generally tapered axial cross-sectional shape to provide a substantially constant active circumferential cross-section as the radius r increases. As used herein, the term "active cross-section," or variation thereof, refers to a cross-section of active material where flux lines and/or a magnetic field exists. In the exemplary embodiment, the circumferential cross-sectional area A of tapered leg 216 of segment 212 that defines recess 220 (shown in FIG. 2) is substantially constant with respect to a radius $r_0$-$r_N$, wherein $r_0$ is a radius at a top 240 of base 214 and $r_N$ is a radius at a bottom 136 of base 114. As such, tapered leg 216 of segment 212 adjacent winding 204 (shown in FIG. 1) has a substantially the same circumferential cross-sectional area at any radius where winding 104 and/or 204 is positioned.

The circumferential cross-sectional area A is defined as b*C, wherein b is a thickness of ring 102 and/or 202 in an axial direction, C is a circumference of ring 102 and/or 202 at radius r, and the radius r is a radius of ring 102 and/or 202. As such, at radius $r_0$, as shown in FIG. 8, the circumferential cross-sectional area A is equal to $b_0*C_0$. At radius $r_1$, as shown in FIG. 9, the circumferential cross-sectional area A is equal to $b_1*C_1$, wherein $b_0*C_0=b_1*C_1=A$. To achieve such a substantially constant circumferential cross-sectional area A, the axial cross-sectional shape of leg 116 and/or 216 is defined by:

$$dV(r_0)=dV(r_1), \text{ where}$$

$$dV(r)=b(r)*2\pi r; \text{ and}$$

$$b_1=b_0*r_0/r_1,$$

where dV(r) is an infinitesimally small volume at the radius r and π is a constant. Bases 114 and/or 214 can also have the tapered axial cross-sectional shape yielded by the above equations; however, in the exemplary embodiment, bases 114 and 214 each have a substantially rectangular axial cross-sectional shape.

Figure 10:
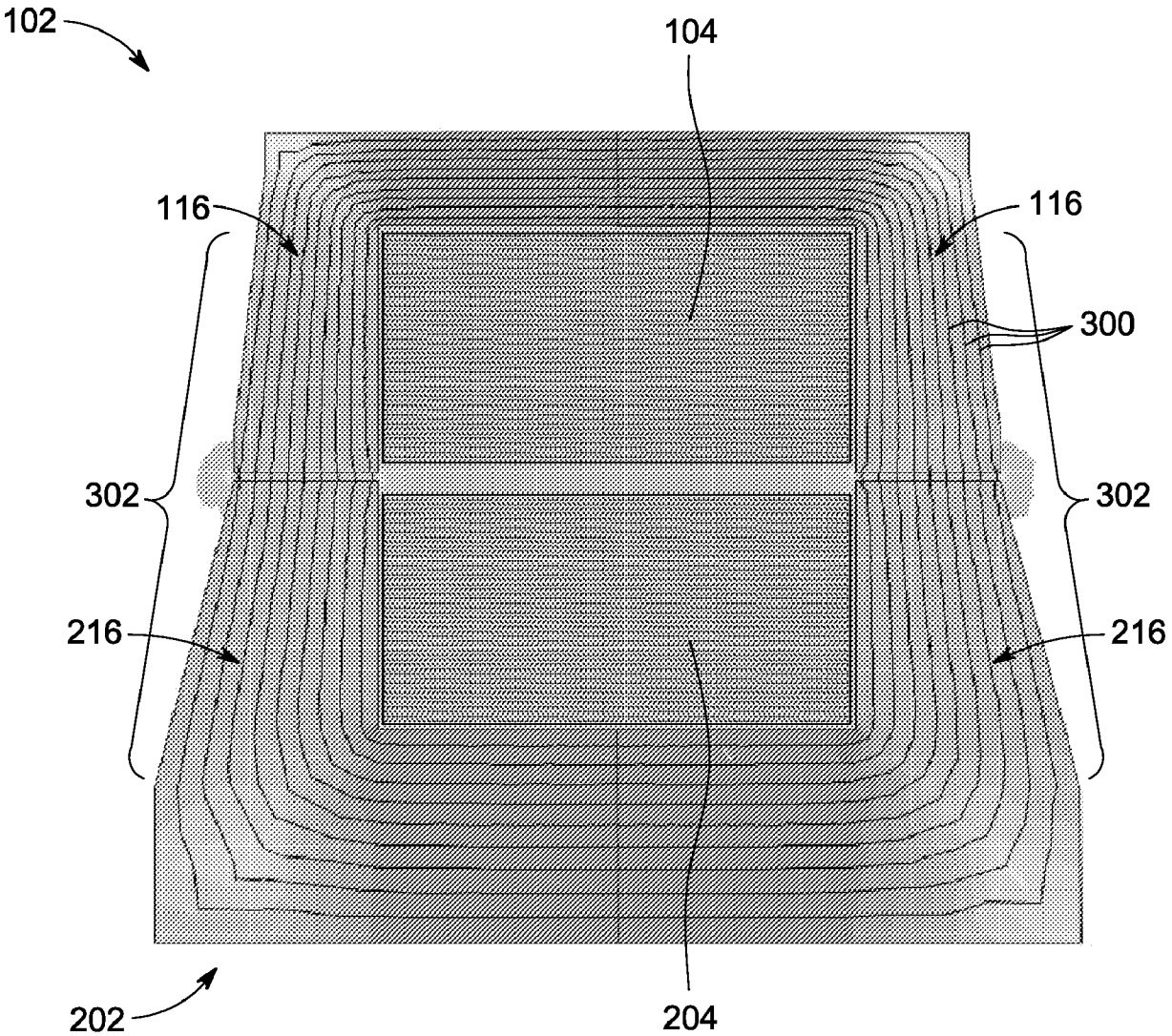

FIG. 10 is an axial cross-sectional view of rings 102 and 202, with flux lines 300 and magnetic density illustrated. In the exemplary embodiment, the axial cross-sectional shape of rings 102 and 202 facilitates providing regions 302 having a substantially constant magnetic density. More specifically, each region 302 includes a set of legs 116 and 216 and is positioned adjacent windings 104 and 202. Further, magnetic flux lines 300 within each region 302 generate a magnetic field having a substantially constant magnetic density within rings 102 and 202 and, more particularly within legs 116 and/or 216.

Figure 11:
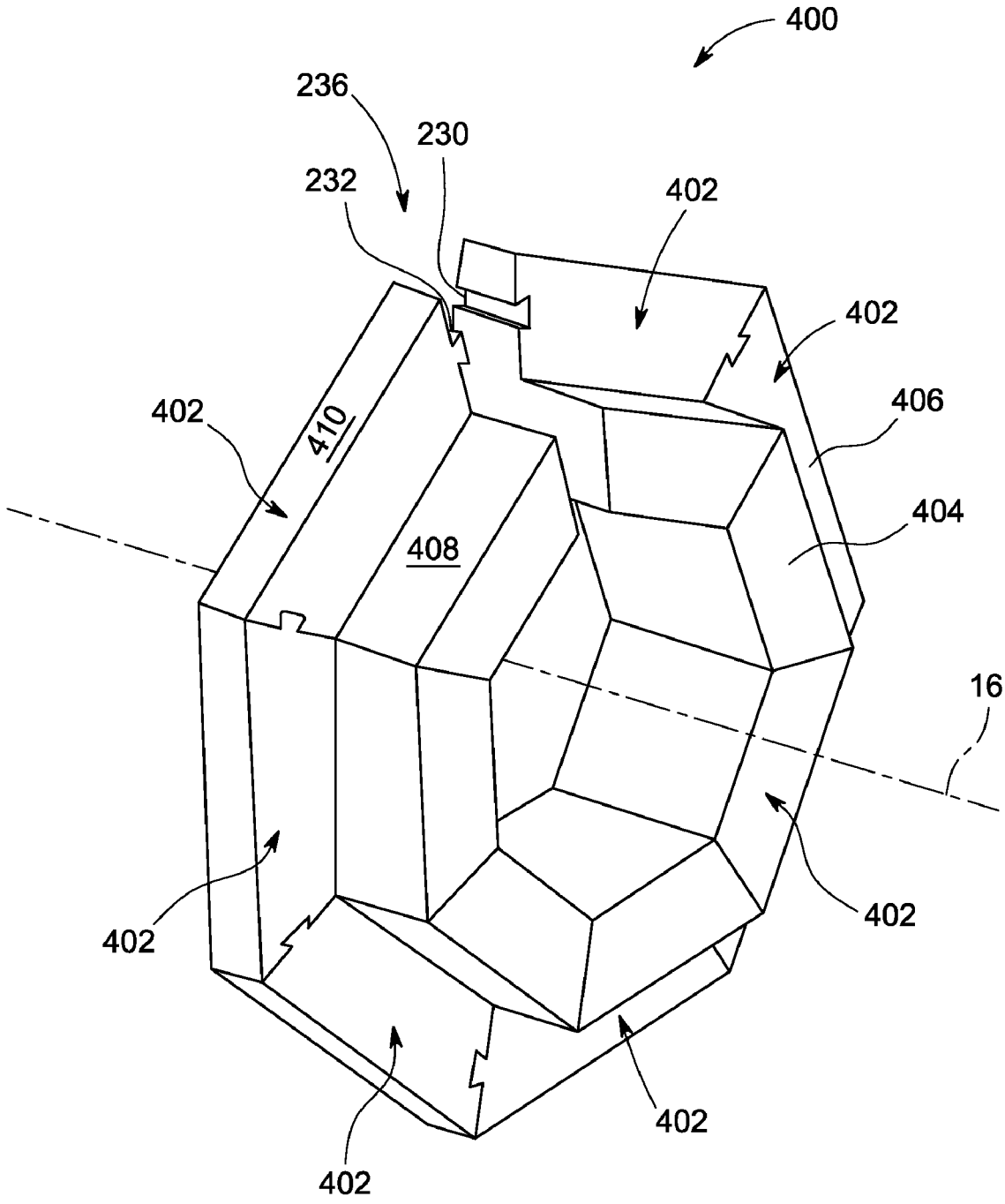
FIG. 11 is a perspective radial view of an alternative secondary sub-ring that may be used with the rotary transformer shown in FIG. 1.

FIG. 11 is a perspective radial view of an alternative secondary sub-ring 400 that may be used with rotary transformer 10 (shown in FIG. 1). Sub-ring 400 is substantially similar to secondary sub-ring 206 (shown in FIG. 6), except sub-ring 400 has a polygonal radial cross-sectional shape as viewed along longitudinal axis 16, rather than having a substantially circular radial cross-sectional shape. As such, components shown in FIG. 11 are labeled with the same reference numbers used in FIGS. 2-10.

In the exemplary embodiment, sub-ring 400 forms a polygonal secondary ring (not shown). A primary ring (not shown) used with the polygonal secondary ring also has a polygonal radial cross-sectional shape that corresponds to the shape of the secondary ring. Alternatively, the primary ring has any suitable radial cross-sectional shape that enables rotary transformer 10 to function as described herein. In the exemplary embodiment, sub-ring 400 includes a plurality of segments 402. Each segment 402 includes a base 404, also referred to herein as a first portion, and a leg 406, also referred to herein as a second portion. Base 404 is substantially similar to base 214 (shown in FIG. 2) except a wall 408 of base 404 is substantially flat, rather than being rounded like wall 218 (shown in FIG. 2). Further, leg 406 is substantially similar to leg 216, except top end 410 of leg 406 is substantially flat, rather than being rounded like end 217 (shown in FIG. 2). As such, the descriptions of base 214 and leg 216 apply to base 404 and leg 406. More specifically, leg 406 is also tapered to provide a substantially constant cross-sectional area along radius r (shown in FIG. 7), as described above. Moreover, gap 236 is defined between two adjacent segments 402, as described above. Alternatively, sub-ring 400 does not include gap 236. In the exemplary embodiment, each segment 402 includes groove 230 and tab 232, as described above. However, it should be understood that groove 230 and/or tab 232 can be omitted from at least one segment 402.

The above-described electrical assembly having a tapered ring of active material provides an electrical machine, such as a rotary transformer, that includes a substantially constant active material volume. More specifically, over at least a portion of the radial direction of the ring, a circumferential cross-sectional area is substantially constant with respect to a radius value. Such a configuration facilitates more efficiently utilizing the active material, as compared to rings having a substantially rectangular axial cross-sectional shape. Further the above-described rotary transformer can be used as lower power and lower frequency, as compared to known machines having segmented electrical assemblies.

The access opening described herein enables easier manufacturing and/or assembly of an electrical assembly, as compared to electrical assemblies having holes that are drilled or otherwise formed after assembly of a ring. More specifically, the above-described access opening is formed as the ring is formed, rather than being formed after the ring is formed.

Exemplary embodiments of an electrical assembly for use with a rotary transformer and method for making the same are described above in detail. The methods and apparatus are not limited to the specific embodiments described herein, but rather, components of the apparatus and/or steps of the methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electrical assembly comprising:

a ring comprising at least two annular segments each including a first portion and a second portion, said second portion tapering from said first portion toward an end of said second portion to define a circumferential cross-sectional area of said ring that is substantially constant along a radius of said electrical assembly; and at least one winding coupled about said ring, and wherein said at least two annular segments comprise a plurality of first segments configured to form a first sub-ring and a plurality of second segments configured to form a second sub-ring.

2. An electrical assembly in accordance with claim 1, wherein said second portion is positioned adjacent a side of said at least one winding.

3. An electrical assembly in accordance with claim 1, wherein each annular segment of said at least two annular segments is generally L-shaped with said second portion generally perpendicular to said first portion, said at least two annular segments positioned in series along a longitudinal axis of said ring.

4. An electrical assembly in accordance with claim 1, wherein said at least two annular segments each comprise a tab and a groove, said at least two annular segments coupled together by inserting said tab of a first annular segment of said at least two annular segments into said groove of a second annular segment of said at least two annular segments.

5. An electrical assembly in accordance with claim 1, wherein said ring comprises a circumferential recess configured to receive said at least one winding, said circumferential recess defined by said first portion and said second portion of each segment of said at least two annular segments.

6. An electrical assembly in accordance with claim 1, wherein said ring comprises an access opening defined between adjacent segments of said at least two annular segments.

7. An electrical assembly in accordance with claim 1, wherein a cross-sectional shape of said second portion is defined by:

$$dV(r_0)=dV(r_1), \text{ where}$$

$$dV(r)=b(r)*2\pi r; \textit{ and}$$

$$b_1=b_0*r_0/r_1,$$

where r is a radius of said ring, dV(r) is an infinitesimally small volume at the radius r, b is a thickness of said ring in an axial direction, $\pi$ is a constant, $r_0$ is a first radius value at a top of the second portion, $r_1$ is a second radius value along the second portion, $b_0$ is a first thickness value of the ring at the top of the second portion, and $b_1$ is a second thickness value of the ring along the second portion.

8. A rotary transformer comprising:

a stator;

a rotor positioned proximate to said stator, wherein at least one of said stator and said rotor comprises:

a ring comprising at least two annular segments each including a first portion and a second portion, said second portion tapering from said first portion toward an end of said second portion to define a circumferential cross-sectional area of said ring that is substantially constant along a radius of said electrical ring; and at least one winding coupled about said ring, and wherein said at least two annular segments comprise a plurality of first segments configured to form a first sub-ring and a plurality of second segments configured to form a second sub-ring.

9. A rotary transformer in accordance with claim 8, wherein said second portion is positioned adjacent a side of said at least one winding.

10. A rotary transformer in accordance with claim 8, wherein said at least two annular segments each comprise a dovetail tab and a dovetail groove, said at least two annular segments coupled together by inserting said dovetail tab of a first annular segment of said at least two annular segments into said dovetail groove of a second annular segment of said at least two annular segments.

11. A rotary transformer in accordance with claim 8, wherein said ring comprises a circumferential recess configured to receive said at least one winding, said circumferential recess defined by said first portion and said second portion of each segment of said at least two annular segments.

12. A rotary transformer in accordance with claim 8, wherein said ring comprises an access opening defined between adjacent segments of said at least two annular segments.

13. A rotary transformer in accordance with claim 8, wherein at least one of said stator and said rotor comprises a plurality of windings each configured to operate at a different voltage level than other windings of said plurality of windings.

14. A method of making an electrical assembly having a longitudinal axis and a radius substantially perpendicular to the longitudinal axis, said method comprising:

coupling at least two annular segments circumferentially about the longitudinal axis of the electrical assembly to form a ring, the at least two annular segments each including a first portion and a second portion, the second portion tapering from the first portion toward an end of the second portion to define a circumferential cross-sectional area of the ring that is substantially constant along a radius of the electrical assembly; and coupling at least one winding about the at least two annular segments, and wherein coupling at least two annular segments circumferentially about the longitudinal axis of the electrical assembly comprises: coupling a plurality of first segments circumferentially together to form a first sub-ring; and coupling a plurality of second segments circumferentially together to form a second sub-ring.

15. A method in accordance with claim 14, wherein coupling at least two annular segments circumferentially about the longitudinal axis of the electrical assembly comprises coupling a tab of a first annular segment of the at least two annular segments into a groove of a second annular segment of the at least two annular segments to form the ring.

16. A method in accordance with claim 14, wherein coupling at least two annular segments circumferentially about the longitudinal axis of the electrical assembly comprises coupling the at least two annular segments in series circumferentially about the longitudinal axis to define an access opening between a first annular segment of the at least two annular segments and a second annular segment of the at least two annular segments.

17. A method in accordance with claim 14, further comprising positioning the first sub-ring and the second sub-ring in series along the longitudinal axis, the first sub-ring and the second sub-ring forming the ring of at least one of a stator of a rotary transformer and a rotor of the rotary transformer.

* * * * *